US006520503B1

(12) United States Patent
Porto

(10) Patent No.: US 6,520,503 B1
(45) Date of Patent: Feb. 18, 2003

(54) COMBINATION CRAPS AND ROULETTE GAME

(76) Inventor: Michael G. Porto, P.O. Box 338, Bronx, NY (US) 10472

( * ) Notice: Subject to any disclaimer, the term of this patent is extended or adjusted under 35 U.S.C. 154(b) by 0 days.

(21) Appl. No.: 09/724,243

(22) Filed: Nov. 28, 2000

Related U.S. Application Data

(60) Provisional application No. 60/221,904, filed on Jul. 31, 2000, provisional application No. 60/230,254, filed on Sep. 6, 2000, and provisional application No. 60/238,149, filed on Oct. 6, 2000.

(51) Int. Cl.[7] ..... A63F 5/04

(52) U.S. Cl. ..... 273/274; 273/138.1; 273/142 R; 273/142 E

(58) Field of Search ..... 273/274, 142 E, 273/142 R, 142 F, 142 G, 142 H, 142 HA, 142 J, 142 JA, 142 JB, 142 JC, 142 JD, 142 D, 138.1

(56) References Cited

U.S. PATENT DOCUMENTS 1,520,697 A * 12/1924 Carlson 3,819,186 A * 6/1974 Hinterstocker

FOREIGN PATENT DOCUMENTS

| | | | |
|---|---|---|---|
| GB | 949733 | * | 2/1964 |
| WO | WO 0029082 | * | 3/2000 |

* cited by examiner

*Primary Examiner*—Benjamin H. Layno
(74) *Attorney, Agent, or Firm*—Scully, Scott, Murphy & Presser

(57) ABSTRACT

A combination craps and roulette game includes: a game surface, the game surface having indicia thereon for displaying bets for both craps and roulette; and a wheel having a plurality of slots, each of the plurality of slots corresponding to a face of at least one die, the wheel also having means for retaining and directing a rolled ball such that the rolled ball comes to rest in one of the plurality of slots. Each of the plurality of slots preferably corresponds to each of a possible combination of faces of a pair of dice and a slot corresponding to the number zero. More preferably, the plurality of slots are color coded based on the combination of faces of the pair of dice to which it corresponds. The wheel is also provided independent of the game surface. A mini-roulette game is also provided which makes use of the wheel of the present invention.

18 Claims, 6 Drawing Sheets

COMBINATION CRAPS AND ROULETTE GAME

CROSS-REFERENCE TO RELATED APPLICATIONS

This application is a conversion of provisional patent applications 60/221,904 filed Jul. 31, 2000; 60/230,254 filed Sep. 6, 2000; and 60/238,149 filed Oct. 6, 2000.

BACKGROUND OF THE INVENTION

1. Field of the Invention

The present invention relates generally to games, more particularly, to a combination craps and roulette game and a mini-roulette game as well as a gaming wheel for use therein.

2. Prior Art

Craps and roulette have been known as forms of gambling for centuries. All major casinos as well as smaller gambling venues have some form of these two gambling games, generally played on large gaming tables. The basic rules for craps and roulette are well known to even non-gamblers. Roulette uses a rotating gaming wheel having numbered and colored slots. If a player picks (bets) a number/color of a slot that a rolled ball falls into, that player wins. The player wins differing amounts depending upon the statistical odds the casino pays for such a bet. Craps involves the throwing of dice and betting on the outcome of the dice.

Typically, the types of gamblers who frequent the craps and roulette tables in casinos are very different. Craps players are typically the more sophisticated gamblers and typically bet larger amounts while roulette is generally favored by the less sophisticated gamblers for its simplicity. Very often a married couple will be split between the craps and roulette table in a casino, one being intimidated by the perceived complexity of craps, the other being turned off by the perceived lack of excitement of roulette. Therefore, the two gamblers spend most of their time at a casino separate and neither gambler is introduced to the game of the other.

Lastly, casinos are always looking for ways to make the most efficient use of their floor space and to introduce new games that will entice the public into their casinos.

In view of the prior art, there is a need for gaming tables in which both craps and/or roulette can be played simultaneously and which introduces a type of gambling that the participants would not ordinarily be interested in. There is also a need in the art for gaming tables which minimize the amount of casino floor space needed.

SUMMARY OF THE INVENTION

Therefore it is an object of the present invention to provide a combination craps and roulette game in which craps and/or roulette can be played simultaneously.

It is a further object of the present invention to provide a combination craps and roulette game in which participants on one of the two games are introduced to the other game.

It is yet a further object of the present invention to provide a combination craps and roulette game which allows groups of people playing both craps and roulette play on the same gaming table.

It is still yet a further object of the present invention to provide a combination craps and roulette game as well as a mini-roulette game which makes for efficient usage of casino floor space.

Accordingly, a combination craps and roulette game is provided. The combination craps and roulette game comprises: a game surface, the game surface having indicia thereon for displaying bets for both craps and roulette; and a wheel having a plurality of slots, each of the plurality of slots corresponding to a face of at least one die, the wheel also having means for retaining and directing a rolled ball such that the rolled ball comes to rest in one of the plurality of slots.

In a preferred implementation of the combination craps and roulette game of the present invention, each of the plurality of slots corresponds to each of a possible combination of faces of a pair of dice. Furthermore, it is preferred to provide an additional slot corresponding to the number zero.

In a more preferred implementation of the combination craps and roulette game of the present invention, the plurality of slots are color coded based on the combination of faces of the pair of dice to which it corresponds. Preferably, any combination of faces of the pair of dice which is less than seven is color coded in a first color, any combination of faces of the pair of dice which is greater than seven is color coded in a second color, and any combination of faces of the pair of dice which is seven is color coded in a third color. The first color is preferably red, the second color is preferably black, and the third color is preferably white. In the case where a zero slot is added, zero is color coded in a fourth color, preferably, green.

The combination craps and roulette game of the present invention is preferably in the form of a casino gaming table.

Also provided is a wheel for determining a winner of a bet. The wheel comprises: a plurality of slots, each of the plurality of slots corresponding to a face of at least one die; and means for retaining and directing a rolled ball such that the rolled ball comes to rest in one of the plurality of slots. The wheel preferably is configured as previously described with regard to the wheel of the combination craps and roulette game.

Still yet provided is a roulette game comprising: a game surface, the game surface having indicia thereon for displaying bets for roulette; and a wheel having a plurality of slots, each of the plurality of slots corresponding to a face of at least one die, the wheel also having means for retaining and directing a rolled ball such that the rolled ball comes to rest in one of the plurality of slots.

BRIEF DESCRIPTION OF THE DRAWINGS

These and other features, aspects, and advantages of the apparatus and methods of the present invention will become better understood with regard to the following description, appended claims, and accompanying drawings where:

DETAILED DESCRIPTION OF THE PREFERRED EMBODIMENT

Although this invention is applicable to numerous and various types of gaming devices, it has been found particularly useful in the environment of a gaming table for use in a casino. Therefore, without limiting the applicability of the invention to a gaming table for use in a casino, the invention will be described in such environment.

Figure 1:
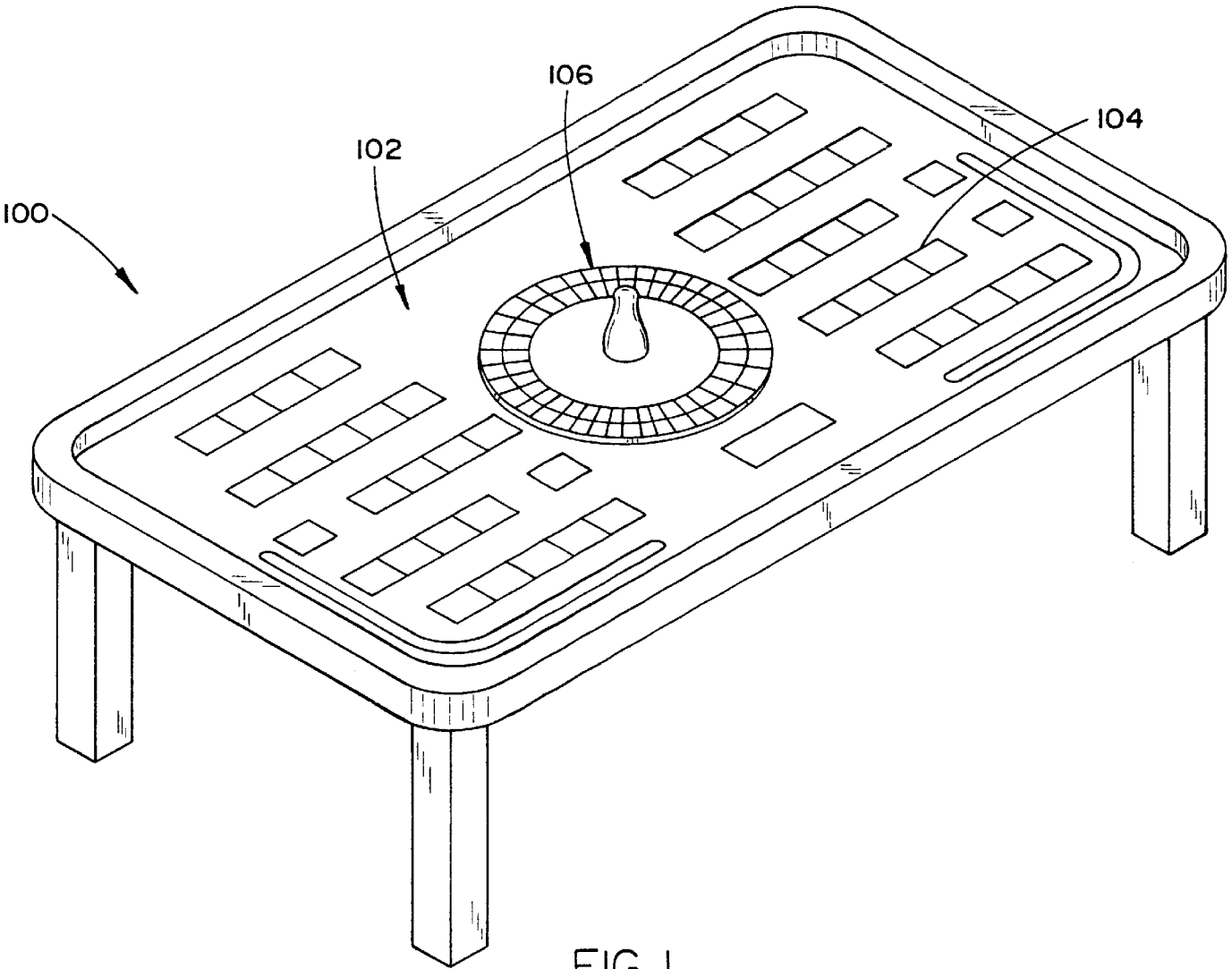
FIG. 1 illustrates the combination craps and roulette game of the present invention in the form of a casino gaming table.

Referring now in detail to FIG. 1, a combination craps and roulette game in the form of a casino gaming table is shown therein, the game being referred to generally by reference numeral 100. The combination craps and roulette game 100 has a game surface 102. The game surface 102 is fabricated from conventional materials known in the art, such as felt. The game surface 102 also has indicia 104 printed, silk-screened or the like thereon. The indicia displays bets for both craps and roulette as will be discussed below. The game 100 also has a wheel 106, similar to wheels known in the art for use in roulette games. However, unlike conventional roulette wheels, the wheel 106 of the combination craps and roulette table 100 of the present invention replaces the numbers usually found thereon with the 36 possible combinations of a pair of dice.

Figure 2A:
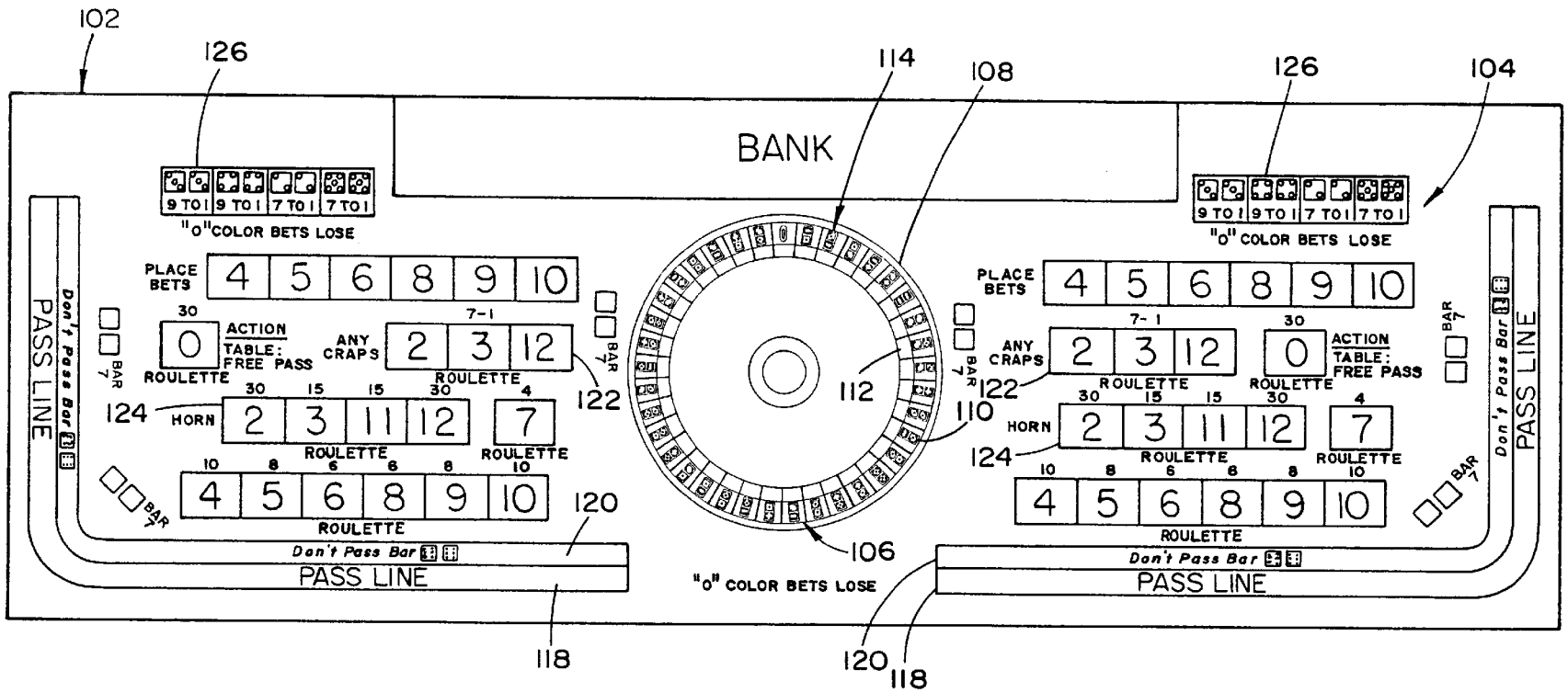
FIG. 2A illustrates a first preferred layout of a game surface and wheel of the combination craps and roulette game of the present invention.
Figure 4:
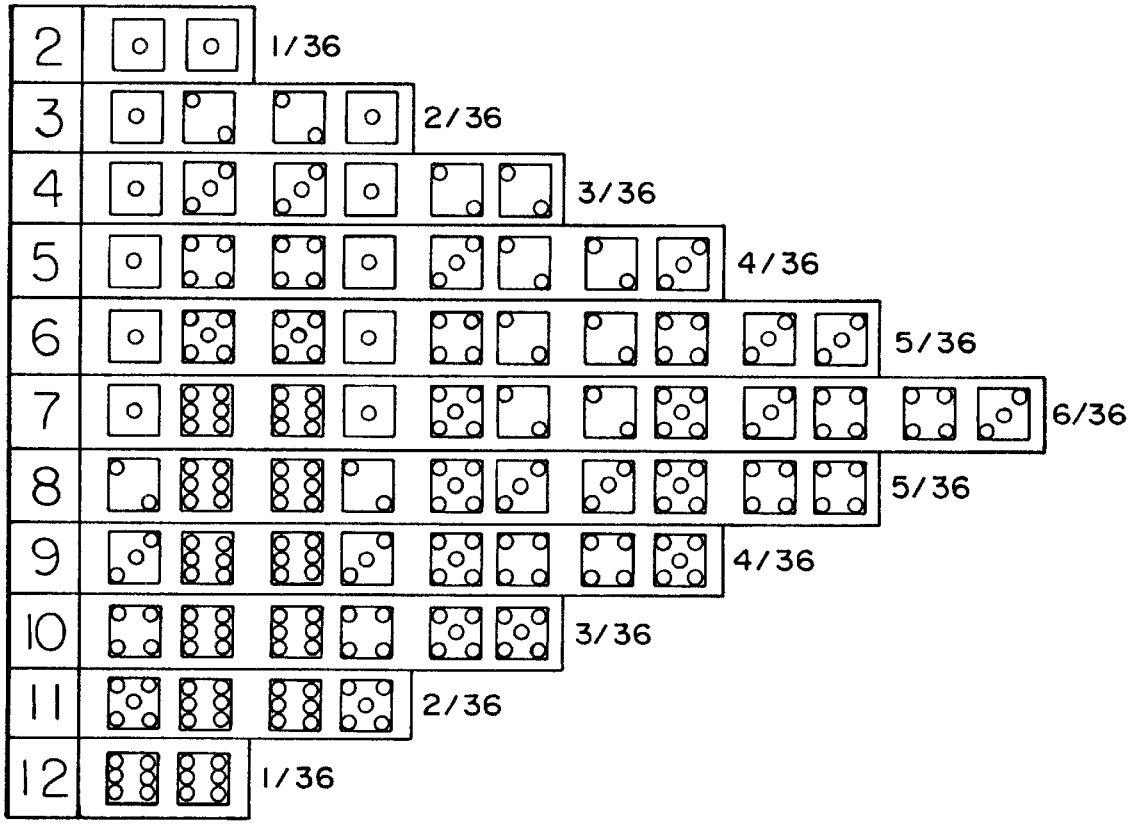
FIG. 4 illustrates the possible combinations of a pair of dice.

Referring now to FIG. 2A, the wheel 106 of the combination craps and roulette game of the present invention is shown in more detail. Generally, the wheel 106 includes a base 108 and a rotatable upper portion 110 which rotates relative to the base 108. The upper rotatable portion 10 has a plurality of slots 112. Each of the plurality of slots 112 corresponds to a face of at least one die, and preferably to all possible combinations of faces of a pair of dice. All such possible 36 combinations are illustrated in FIG. 4. The wheel 106 also has means for retaining and directing a rolled ball such that the rolled ball comes to rest in one of the plurality of slots 112. The means for retaining and directing the rolled ball are well known in the art and only a brief description is therefore presented. Generally, the wheel includes an open annular slot in which the ball is rolled. Upon losing velocity, the ball falls into the region of the wheel 106 containing the slots 112, eventually coming to rest in one of the plurality of slots 112. The wheel 106 is shown centered on the game surface 102 in FIGS. 1 and 2A. However, it is shown in such configuration by way of example only and not to limit the scope of the invention. Those skilled in the art will realize that the wheel 106 can be positioned anywhere on the game surface 102 or on a separate surface independent from the game surface without departing from the scope or spirit of the present invention.

Figure 3:
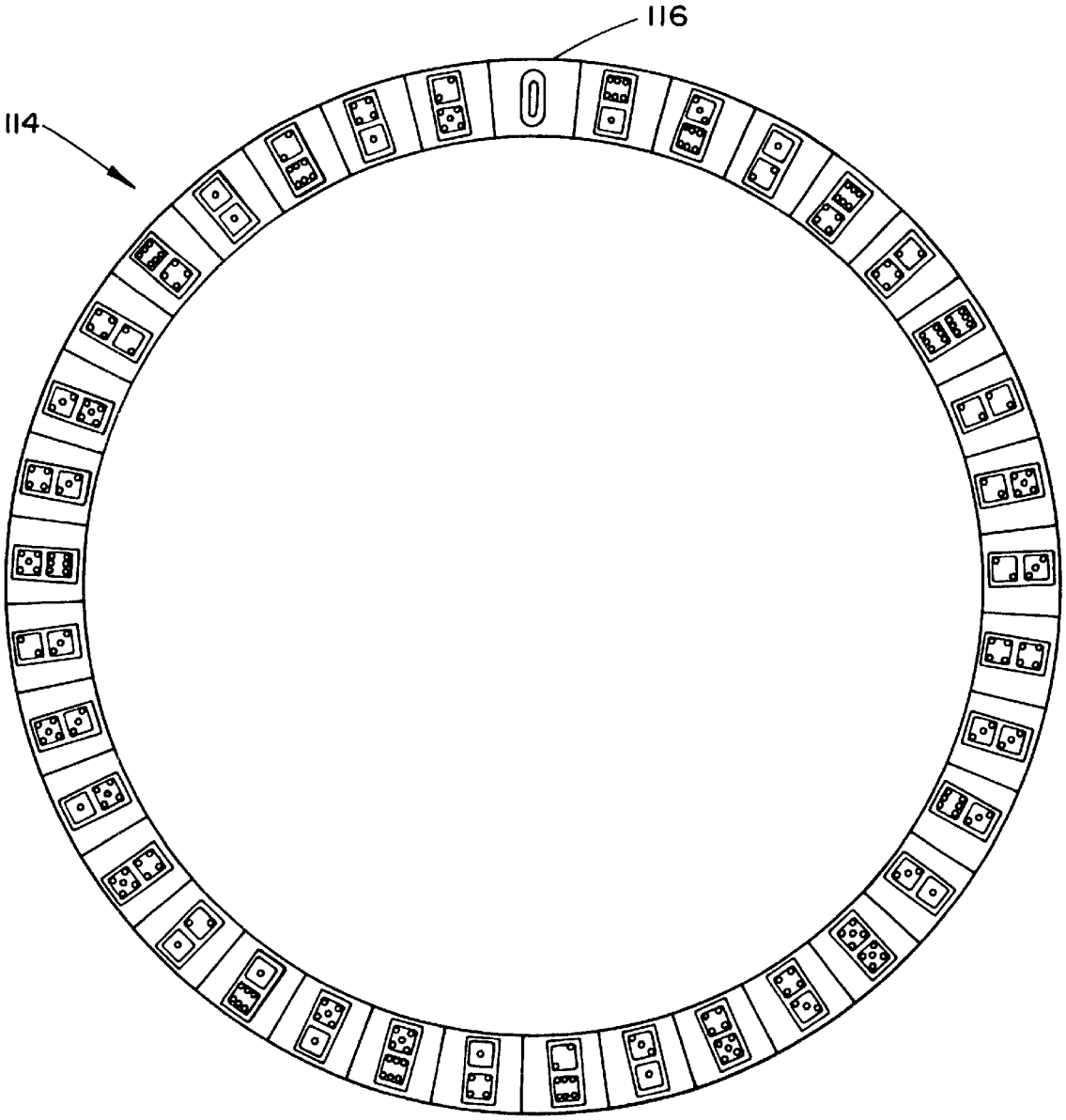
FIG. 3 illustrates a preferred layout for the slots of the wheel of FIGS. 2A and 2B.

Referring now to FIG. 3, there is shown a dice section 114 of the wheel 106 which is adjacent the slots 112. The dice section 114 has indicia corresponding to the dice combinations for each of the slots 112. Preferably, in addition to all of the possible combinations of faces for a pair of dice, the wheel 106 also has a slot 112 corresponding to a zero (or double zero as is used in some countries). A zero slot is used to provide another bet for the players and in some instances for manufacturing economy, since a 37 slot wheel is more commercially available than a 36 slot wheel. Those skilled in the art will recognize that a zero slot can be omitted without departing from the scope or spirit of the present invention.

As clearly seen in FIG. 3, all 36 combinations of faces of a pair of dice are displayed on the dice section 114 along with a zero position 116. Preferably, the plurality of slots 112 are also color coded based on the combination of faces of the pair of dice to which it corresponds. The color coding of the slots and corresponding dice section adds yet another bet for players.

Preferably, any combination of faces of the pair of dice which is less than seven (2–6) are color coded in a first color, such as red. Any combination of faces of the pair of dice which is greater than seven (8–12) are color coded in a second color, such as black. Any combination of faces of the pair of dice which equal seven are color coded in a third color, such as white. Lastly, zero is color coded in a fourth color, such as green.

Referring back to FIG. 2A, a preferred game surface 102 of FIG. 1 is shown in more detail. The game surface 102 is supplied with indicia 104 displaying both bets for craps and roulette. Once players place their bets by placing chips (or having casino personnel place their chips) on an appropriate indicia 104, the wheel is spun and generally no further bets are allowed. Each spin determines the winners and losers of the roulette portion of the game, while several spins may be necessary to determine the winners and losers of the crap portion of the game.

In the craps portion of the game, any bet that is available in a conventional craps table is available in the combination craps and roulette game 100 and all odds are the same. For instance, a craps player can play Pass 118 or Don't pass 120, back of the Pass line, Boxes, Any Craps 122 (designated by AC), Horn 124, individual craps numbers, Hardways 126, or individual (7) or (11). A roulette player can play any one or multiples of (0, 2, 3, 4, 5, 6, 7, 8, 9, 10, 11, or 12) with the odds of that number being spun being displayed over the number that is being played. For instance, a bet of "2" has odds of 30–1. All indicia 104 which is available for a roulette bet is indicated with the word "Roulette". An "Any Craps" bet is also a roulette bet (one bet will cover the three numbers 2, 3, and 12 and will receive odds of 7–1). In addition, a roulette player can bet either red or black.

Figure 2B:
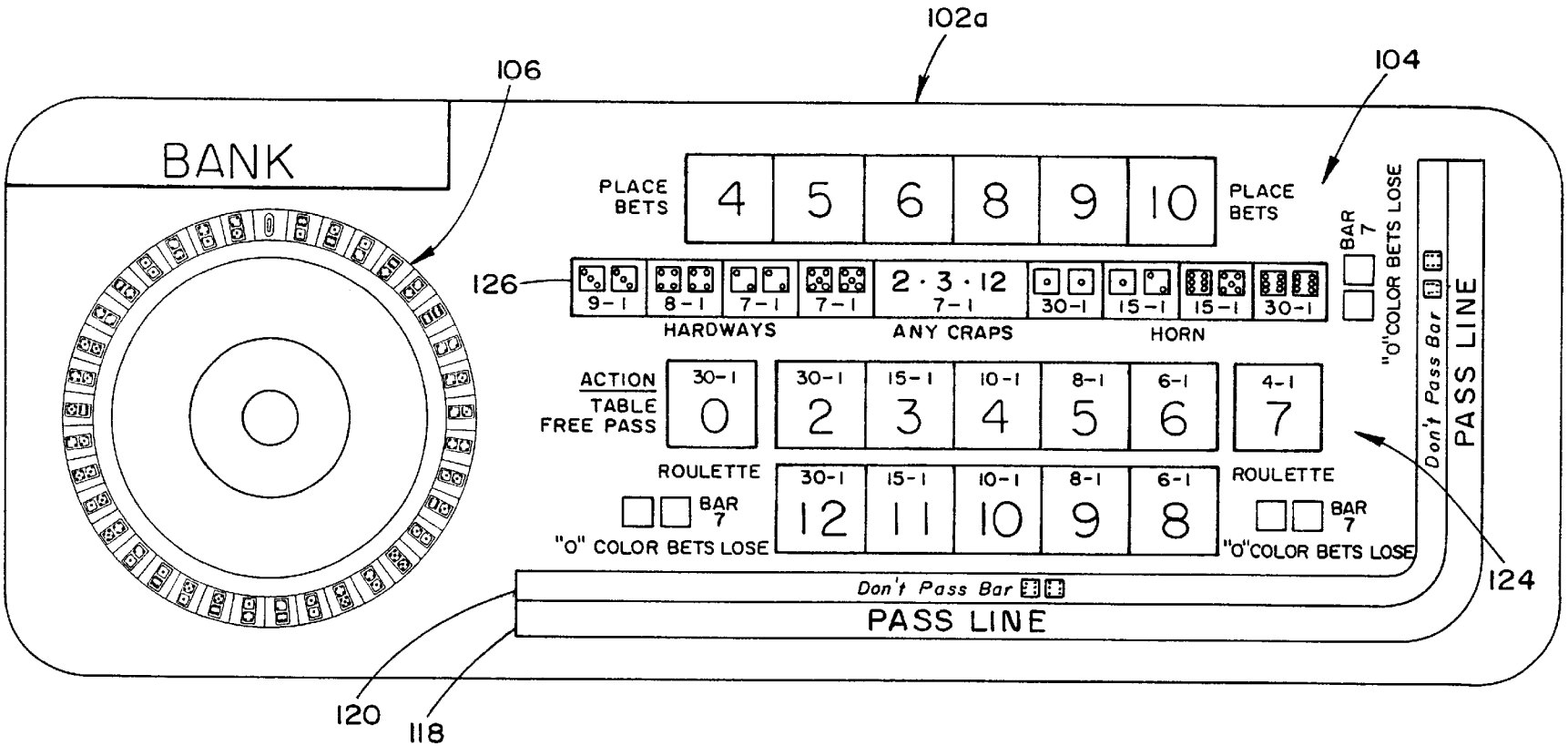
FIG. 2B illustrates a second preferred layout of a game surface and wheel of the combination craps and roulette game of the present invention.

If a zero is spun, color bets lose. A zero bet is said to have "action" in the roulette portion of the game which means that all bets besides colors (red/black) have a free pass. Thus, spinning a zero has bearing only on those who bet zero and those who bet red or black. All plays of roulette are one time spins of the wheel 106. Since there are more than one combination of the numbers for roulette (except 2 and 12), the odds are lower on the combination craps and roulette game 100 than on a conventional roulette table. However, a player has more opportunity to win on the combination craps and roulette game 100 of the present invention than on a conventional roulette game. An alternative game surface 102*a* is shown in FIG. 2B. The alternative game surface 102*a* has only one set of indicia 104 whereas game surface 102 has a set of indicia 104 on both sides of the wheel 106. While game surface 102 allows more participants in the game, game surface 102*a* can be made smaller, thereby minimizing the need for casino floor space.

In summary, as is evident to those skilled in the art, the combination craps and roulette game of the present invention allows users to play craps, to play roulette, or to play both simultaneously, on the same table. The main difference between craps on a conventional craps table and on the combination craps and roulette game 100 of the present invention is that the rolling of dice is eliminated. However, a craps player will have the same choices of bets as he or she has on a conventional craps table. The combination craps and roulette game of the present invention replaces the dice of craps with a wheel from roulette. However, the numbers on a conventional roulette wheel are replaced with the 36 possible combinations of a pair of dice. As discussed above, a zero is also preferably included on the wheel. Both the craps and roulette bets are designated on the game surface 102 along with their corresponding odds.

Figure 2C:
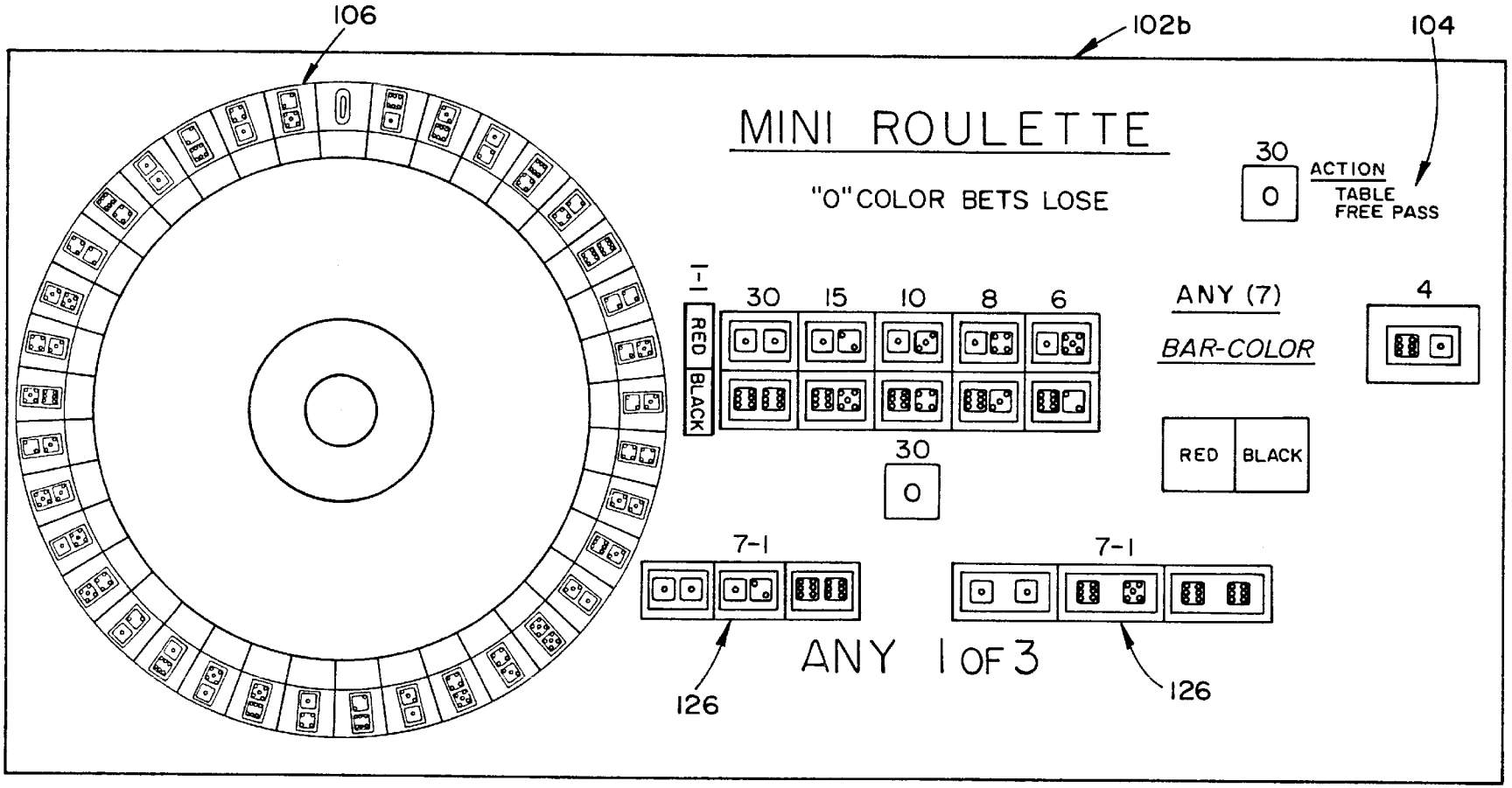
FIG. 2C illustrates a preferred layout of a game surface and wheel of a mini-roulette game utilizing the wheel of the present invention.

Referring now to FIG. 2C, where like numerals refer to like features, there is illustrated yet another game surface

102*b* for a gaming table, referred to as mini-roulette. The mini-roulette game also makes use of the wheel 106 described above. Game surface 102*b* includes only indicia 104 for roulette. Thus, it can be used to play roulette according to the ordinary rules of roulette but with the numbers of the dice being the numbers that can be bet upon. Those skilled in the art will realize that because the possible numbers on a pair of dice are much less than the amount of numbers on a conventional roulette wheel, the game surface 102*b* and therefore, the gaming table, can be made much smaller than conventional roulette games.

The wheel and game surfaces discussed above are illustrated and described herein as being a physical embodiment by way of illustration only. Those of skill in the art will realize that "wheel" and "game surface" as used in the present invention also contemplates electronic representations thereof which can be generated on a display screen, such as in an electronic game. Of course, in such an embodiment, the "slots" and "rolled ball" are not physical embodiments but electronic representations thereof.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A combination craps and roulette game comprising:

a game surface, the game surface having indicia thereon for displaying bets for both craps and roulette; and a wheel having a plurality of slots, each of the plurality of slots corresponding to a face of at least one die, the wheel also having means for retaining and directing a rolled ball such that the rolled ball comes to rest in one of the plurality of slots;

wherein the crap bets comprise two or more of pass bets; don't pass bets; hardways bets; any craps bets; 2 craps, 3 craps, and 12 craps bets; 7 and 11 bets, win bets, buy bets, and lay bets; and wherein the roulette bets comprise a numeral corresponding to the face of the at least one die.

2. The combination craps and roulette game of claim 1, wherein the wheel is rotatable.

3. The combination craps and roulette game of claim 1, wherein each of the plurality of slots corresponds to each of a possible combination of faces of a pair of dice.

4. The combination craps and roulette game of claim 3, further comprising a slot corresponding to the number zero.

5. The combination craps and roulette game of claim 4, wherein the plurality of slots are color coded based on the combination of faces of the pair of dice to which it corresponds.

6. The combination craps and roulette game of claim 5, wherein any combination of faces of the pair of dice which is less than seven is color coded in a first color, any combination of faces of the pair of dice which is greater than seven is color coded in a second color, any combination of faces of the pair of dice which is seven is color coded in a third color, and zero is color coded in a fourth color.

7. The combination craps and roulette game of claim 6, wherein the first color is red, the second color is black, the third color is white, and the fourth color is green.

8. The combination craps and roulette game of claim 3, wherein the plurality of slots are color coded based on the combination of faces of the pair of dice to which it corresponds.

9. The combination craps and roulette game of claim,8 wherein any combination of faces of the pair of dice which is less than seven is color coded in a first color, any combination of faces of the pair of dice which is greater than seven is color coded in a second color, and any combination of faces of the pair of dice which is seven is color coded in a third color.

10. The combination craps and roulette game of claim 9, wherein the first color is red, the second color is black, and the third color is white.

11. The combination craps and roulette game of claim 1, wherein the game is a casino gaming table.

12. The combination craps and roulette game of claim 1, wherein the game is an electronic game and the rolled ball is an electronic representation thereof.

13. A wheel for determining a winner of a bet, the wheel comprising:

a plurality of slots, each of the plurality of slots corresponding to each of a possible combination of faces of a pair of dice; and means for retaining and directing a rolled ball such that the rolled ball comes to rest in one of the plurality of slots;

wherein the plurality of slots are color coded based on the combination of faces of the pair of dice such that the combination of faces of the pair of dice that are less than a predetermined number are color coded in a first color and the combination of faces of the pair of dice that are greater than-the predetermined number are color coded in a second color.

14. The wheel of claim 13, further comprising a base upon which the plurality of slots rotates.

15. The wheel of claim 13, further comprising a slot corresponding to the number zero.

16. The wheel of claim 13, wherein any combination of faces of the pair of dice which is less than seven is color coded in the first color, any combination of faces of the pair of dice which is greater than seven is color coded in the second color, and any combination of faces of the pair of dice which is seven is color coded in a third color.

17. The wheel of claim 16, wherein the first color is red, the second color is black, and the third color is white.

18. An electronic combination craps and roulette game comprising a display for displaying a game surface having bet indicia thereon for displaying bets for both craps and roulette, wherein the crap bets comprise two or more of pass bets; don't pass bets; hardways bets; any craps bets; 2 craps, 3 craps, and 12 craps bets; 7 and 11 bets, win bets, buy bets, and lay bets and wherein the roulette bets comprise a numeral corresponding to a face of at least one die, said display further comprises a wheel having die indicia corresponding to each face of at least one die, the wheel also having means for selecting one of the die indicia.

* * * * *